US005964522A

United States Patent [19]

Schaefer et al.

[11] Patent Number: 5,964,522

[45] Date of Patent: Oct. 12, 1999

[54] DUAL-REFLECTOR FLOODLIGHT

[75] Inventors: Gary Eugene Schaefer; Wayne Douglas Campbell, both of Kitchener, Canada

[73] Assignee: Canlyte Inc., Lachine, Canada

[21] Appl. No.: 08/980,242

[22] Filed: Nov. 28, 1997

[51] Int. Cl.[6] ..... F21V 7/00

[52] U.S. Cl. ..... 362/350; 362/346; 362/297; 362/263

[58] Field of Search ..... 362/297, 347, 362/350, 346, 261, 263

[56] References Cited

U.S. PATENT DOCUMENTS

| | | | |
|---|---|---|---|
| 1,079,315 | 11/1913 | Cassidy . | |
| 1,509,744 | 9/1924 | Wilson . | |
| 2,220,298 | 11/1940 | Stair et al. . | |
| 2,275,560 | 3/1942 | Saaf . | |
| 2,913,570 | 11/1959 | Gough et al. . | |
| 4,261,029 | 4/1981 | Mousset | 362/283 |
| 4,635,172 | 1/1987 | Steinke | 362/276 |
| 4,789,923 | 12/1988 | Sales | 362/346 |
| 4,799,136 | 1/1989 | Molnar | 362/300 |
| 4,864,476 | 9/1989 | Lemons et al. | 362/348 |
| 5,016,150 | 5/1991 | Gordin et al. | 362/263 |
| 5,161,883 | 11/1992 | Gordin et al. | 362/263 |
| 5,313,379 | 5/1994 | Lemons et al. | 362/298 |
| 5,586,015 | 12/1996 | Baldwin et al. | 362/263 |

*Primary Examiner*—Laura K. Tso
*Attorney, Agent, or Firm*—Dimock Stratton Clarizio; Mark B. Eisen

[57] ABSTRACT

The invention provides a floodlight in which the lamp axis is offset from the axis of a reflector. In the preferred embodiment an arc lamp is oriented vertically when the reflector axis is oriented at an oblique downward angle. The reflector includes a back reflector having a parabolic reflecting surface and a front reflector having at least one ellipsoidal reflecting surface disposed symmetrically about the reflector axis. In a preferred embodiment the front reflector is hinged to the back reflector and can be pivoted away from the back reflector to expose the lamp to facilitate cleaning and maintenance.

26 Claims, 5 Drawing Sheets

DUAL-REFLECTOR FLOODLIGHT

FIELD OF INVENTION

This invention relates to lights. In particular, this invention relates to arc type recreational floodlights for illuminating recreational and sports venues.

BACKGROUND OF THE INVENTION

The illumination of recreational and sports facilities and venues typically involves the use of directional floodlights mounted on tall structures such as poles, buildings etc. An array of such floodlights is employed to provide a uniform intensity of light across key areas such as playing fields or recreational surfaces where bright, uniform illumination is required.

Luminaires utilizing arc type light sources in conjunction with parabolic reflectors are commonly used in such applications, particularly outdoors. Typically such light sources are designed with the axis of the arc lamp coaxially aligned with the axis of symmetry of the reflector. However, when a metal halide arc lamp is aimed at a specific point on a playing field or other target surface it experiences reduced light output due to the well known "tilt factor", by which the efficiency of the lamp is reduced when the lamp is tilted out of its optimal designed operating range. With an arc lamp that is coaxially aligned with the axis of the reflector, tilting the reflector toward the target surface necessarily results in tilting of the arc lamp, which accordingly reduces the light output of the lamp.

It is known to provide such a luminaire with the axis of the arc lamp offset from the axis of the reflector, as for example the floodlight described in U.S. Pat. No. 5,016,150 issued May 14, 1991 to Gordin et al., which is incorporated herein by reference. The luminaire taught by Gordin et al primarily utilizes a conventional hemispherical or truncated hemispherical reflector in which the arc lamp is oriented horizontally when the reflector is directed at a downward angle. However, this presents a problem in the efficiency and uniformity of the light distribution pattern produced by the floodlight.

Unlike a conventional incandescent lamp, an arc lamp does not radiate light uniformly about the light source. The arc tube is elongated and radiates light of greater intensity through the elongated wall of the tube and relatively poorly approaching the ends of the tube. This is suitable when the lamp is oriented coaxially with the reflector, because a conventional reflector is also designed symmetrically about the wall of the arc tube. However, when the arc tube is mounted in a conventional reflector with its axis offset from the reflector axis, the light distribution pattern produced by the floodlight is no longer uniform.

U.S. Pat. No. 5,016,150 to Gordin et al illustrates in one embodiment a horizontally mounted arc lamp with an asymmetric reflector having an elongated top portion, designed to position the arc tube generally photometrically centered within the reflector. The asymmetric reflector configuration increases the manufacturing cost of the reflector, and can present problems in the alignment of the arc lamp, often requiring a specialized lamp base to ensure that the lamp is properly positioned within the reflector.

Further, mounting the arc lamp horizontally causes undue strain on the neck of the lamp, particularly at the point of attachment to the base. The weight of the bulb and the arc tube is transferred as a torque to the neck, the torque being concentrated about the top of the neck rather than being evenly distributed about the circumference of the neck. Such arc lamps can be fairly heavy, and when subjected to high winds have been known to break at the lamp base for this reason.

SUMMARY OF THE INVENTION

The present invention overcomes these disadvantages by providing a floodlight comprising an arc lamp mounted with its axis offset from the axis of the reflector such that the arc lamp is oriented vertically when the reflector is directed at an oblique downward angle. The vertical orientation of the arc lamp reduces the strain on the neck of the lamp and distributes the weight of the bulb more uniformly about the lamp base.

The invention also provides a two-part reflector system comprising a back reflector having a substantially parabolic reflective surface, and a front reflector having a substantially ellipsoidal reflective surface which compensates for the asymmetric distribution of light resulting from mounting the arc lamp with its axis offset from the reflector axis. In the preferred embodiment the back and front reflectors are connected by a hinge, so that the front reflector can be pivoted about the axis of the hinge away from the lamp to facilitate cleaning and maintenance.

The present invention thus provides a floodlight comprising a reflector having a reflector axis, the reflector comprising a back reflector having a substantially parabolic reflecting surface disposed substantially symmetrically about the reflector axis, a front reflector having at least one substantially ellipsoidal reflecting surface disposed substantially symmetrically about the reflector axis and mounted forwardly of the back reflector, and a lamp receptacle, wherein an arc lamp having a lamp axis and a center of illumination disposed along the lamp axis can be mounted in the lamp receptacle such that the lamp axis is offset from the reflector axis.

The present invention further provides a floodlight comprising a lamp having a lamp axis, a center of illumination disposed along the lamp axis, and an asymmetric light distribution pattern about the center of illumination, a reflector having a reflector axis, the lamp being mounted in the reflector such that the lamp axis is offset from the reflector axis, the reflector comprising a back reflector having a substantially parabolic reflecting surface disposed substantially symmetrically about the reflector axis, and a front reflector having at least one substantially ellipsoidal reflecting surface disposed substantially symmetrically about the reflector axis and mounted forwardly of the back reflector.

The present invention further provides a light fixture comprising a reflector having a reflector axis, the reflector comprising a back reflector and a front reflector mounted forwardly of the back reflector, the front reflector being hingedly connected to the back reflector so as to be pivotable away from the back reflector to expose a lamp.

BRIEF DESCRIPTION OF THE DRAWINGS

In drawings which illustrate by way of example only a preferred embodiment of the invention.

DETAILED DESCRIPTION OF THE INVENTION

Figure 1:
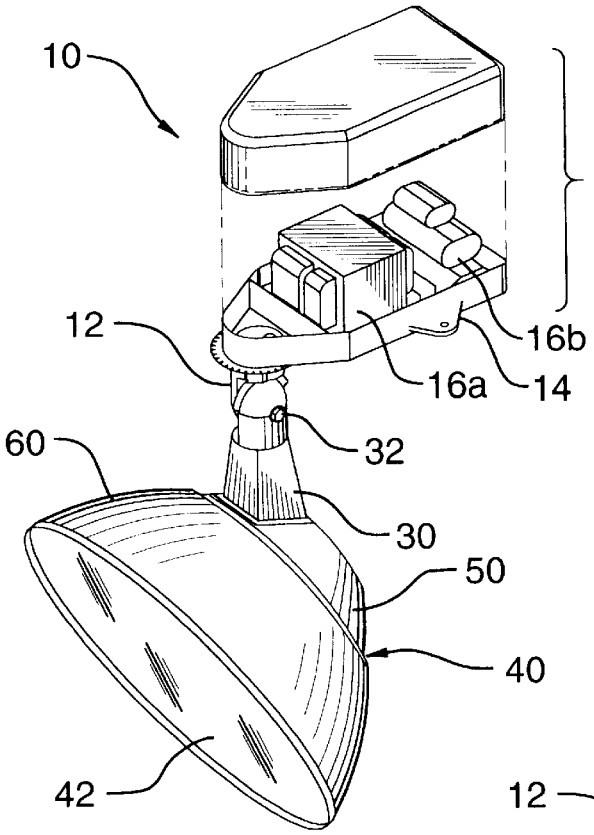
FIG. 1 is a partially exploded perspective view of a floodlight according to the invention.
Figure 2:
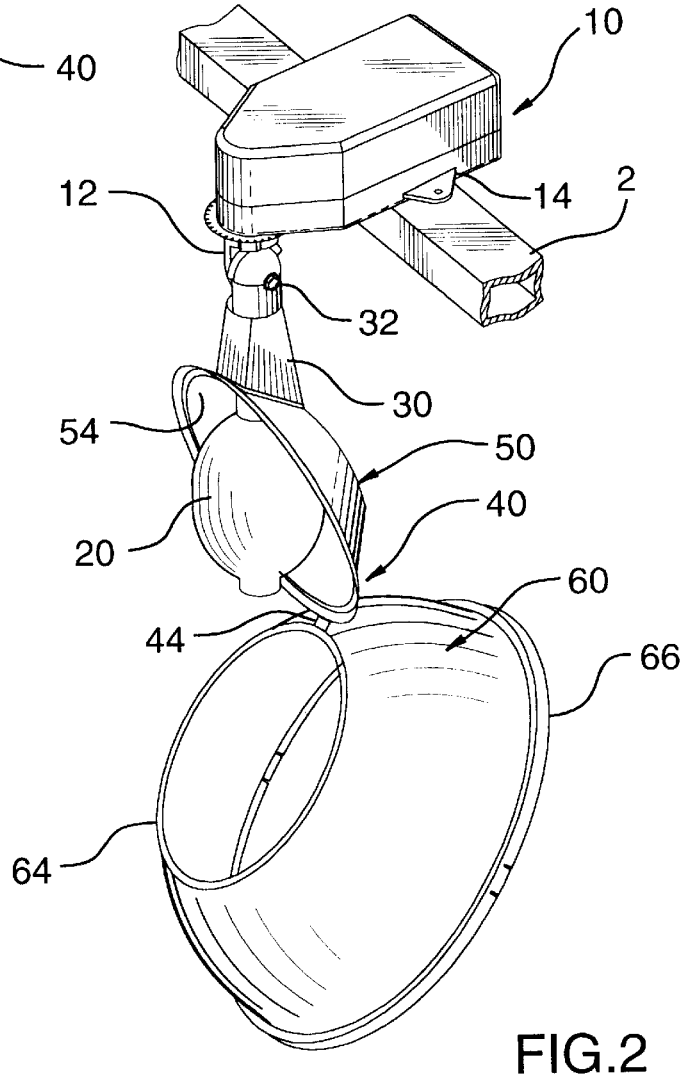
FIG. 2 is a perspective view of the floodlight of FIG. 1 showing the front reflector in the open position.

FIGS. 1 and 2 illustrate a preferred embodiment of a floodlight according to the invention. A ballast housing 10 supports a swivel joint 12 allowing rotational motion of the lamp/reflector assembly within a generally horizontal plane. The housing 10 may be provided with integral mounting tabs 14 for fastening the housing 10 to a structure 2 such as a light standard, post, building etc. and contains a ballast core and capacitors 16*a*, 16*b* compatible with the arc lamp 20 selected for the particular application.

The lamp 20 may be a conventional BT56 high intensity discharge arc lamp consisting of a hermetically sealed bulb 22 containing an arc tube 24 having a longitudinal axis oriented substantially coaxially with the longitudinal axis of the bulb 22 and defining a lamp axis $A_L$. The bulb 22 terminates at a neck 26 disposed partially within a conductive base 28, the base 28 being configured to couple to a standard socket or receptacle (not shown) affixed to a socket housing 30 which covers the exterior of the receptacle, protecting the conductive components from weather conditions, and is pivotally secured to the mounting swivel 12 as at vertical pivot joint 32. The lamp/reflector assembly can thus be selectively pivoted within a generally horizontal plane by rotation of the swivel 12 and within a generally vertical plane by rotation of the pivot joint 32, allowing the reflector 40 to be aimed to fairly precise tolerances and locked in position within a range of rotation of approximately 180° in the horizontal direction and 150° in the vertical direction.

In the preferred embodiment the reflector 40 is composed of aluminum and formed to the desired configuration by conventional spinning and/or hydroform methods. The reflector 40 may be composed of any suitable metal or other reflective material, taking into consideration the weight of the reflector 40, corrosion and heat resistance, reflector absorption and reflectivity.

Figure 4:
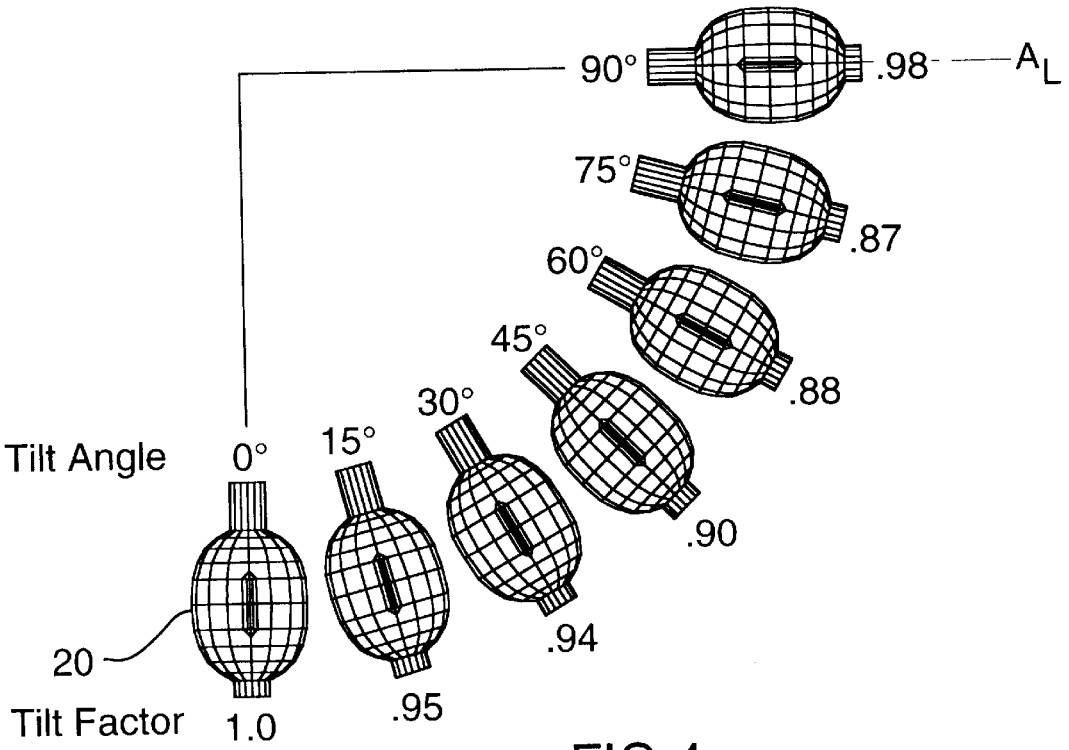
FIG. 4 is a schematic view showing the relative reduction of light intensity emitted from a metal halide arc lamp as a function of the tilt angle of the arc tube.
Figure 5:
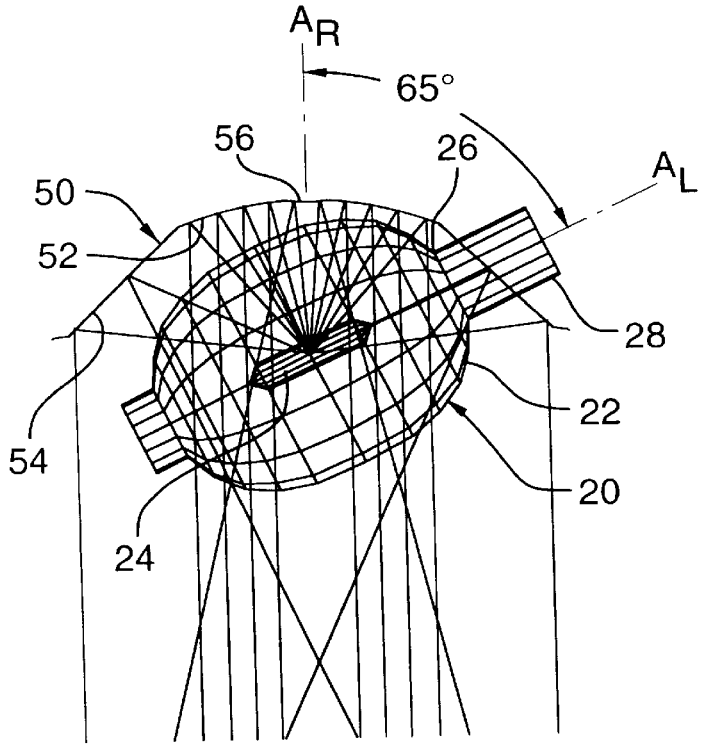
FIG. 5 is a schematic view showing angles of reflection at selected portions of the back reflector, FIGS. 6*a,* 6*b* and 6*c* are schematic views showing angles of reflection of three configurations of the front reflector providing different light distribution patterns.
Figure 7:
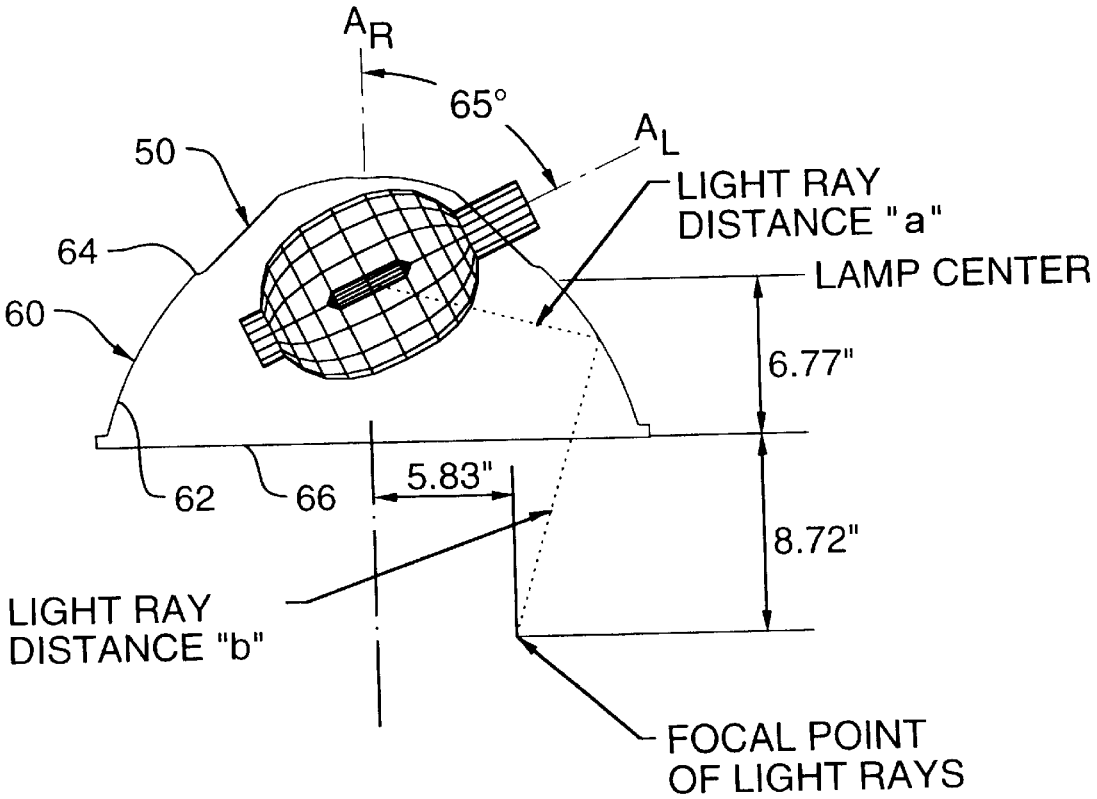
FIG. 7 is a diagrammatic view showing a preferred ellipsoidal configuration of the front reflector profile.

The reflector 40 comprises a back reflector section 50 and a front reflector section 60 arranged in coaxial relation, preferably a glass lens 42 to protect the lamp 20 from inclement weather conditions, and optionally internal louvers (not shown) for controlling glare and undesirable dispersion. The lamp 20 is oriented relative to the back reflector 50 at an angle offset from the axis $A_R$ of the reflector 40, preferably at an angle of approximately 65° as shown in FIGS. 5 to 7. This allows the lamp 20 to be oriented substantially vertically when the reflector 40 is aimed at an angle of 65° from the vertical, which represents an average optimal aiming angle for most sports and recreational applications. Moreover, it can be seen from FIG. 4 that the highest light output reduction occurs when the lamp 20 is tilted between 60° and 75° from the vertical; by orienting the lamp 20 with its axis $A_L$ offset from the reflector axis $A_R$ by about 65°, the reflector can by oriented fully horizontally and the lamp axis $A_L$ will remain at less than a 25° angle from the optimal (vertical) orientation. It will nevertheless be appreciated that the angle between the reflector axis $A_R$ and the lamp axis $A_L$ is a matter of selection for the intended application and can be adapted to take into account the size of the target surface and the height at which the floodlight will be mounted.

The profile of the back reflector 50 is illustrated schematically in FIG. 5. The back reflector 50 is substantially symmetrical and comprises a parabolic reflecting surface 52 disposed symmetrically about the reflector axis $A_R$, designed to provide maximum optical efficiency. Preferably a substantially planar reflecting surface 54 surrounds the parabolic surface 52. The parabolic reflecting surface 52 has its focal point substantially at the center of illumination (ie. the center of the arc tube 24 in the mounted lamp 20), and thus reflects most of the light emitted from the concealed side of the lamp 20 in a direction parallel to the reflector axis $A_R$. A relatively small proportion of the light emitted from the concealed side of the lamp 20 strikes the planar reflecting surface 54 and is reflected across the primary light path. As is conventional, a convex dimple 56 is provided at the center of the parabolic reflecting surface 52 to disperse light that would otherwise reflect directly back at the arc tube 24 and reduce the operating life of the lamp 20.

Figure 3:
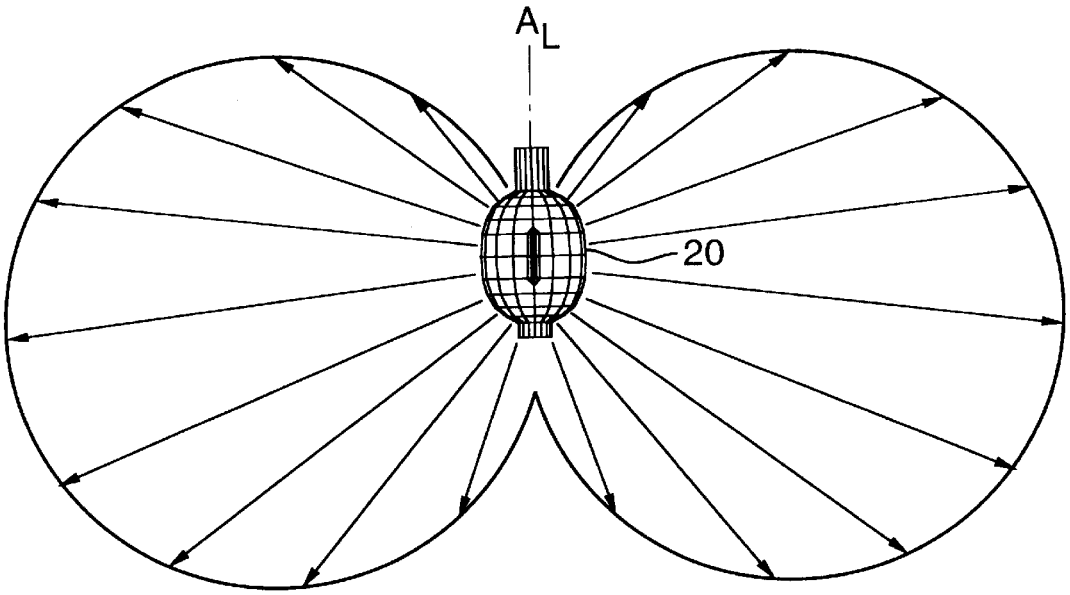
FIG. 3 is a diagrammatic view showing the relative intensity of light emitted from an arc lamp at various angles from the axis of the arc tube.

As shown in FIG. 3, light emitted by the lamp 20 is most intense in the direction orthogonal to the arc tube 24 and relatively weaker approaching the direction of the lamp axis $A_L$. Thus, an asymmetric light distribution pattern results from the offset orientation of the lamp 20 within the reflector 40, with more intense direct illumination on the side of the reflector axis $A_R$ toward the lamp base 28 (shown at the right in FIG. 5) and more intense reflected illumination on the side of the reflector axis $A_R$ opposite the lamp base 28 (shown at the left in FIG. 5). This results in bright spots in the light distribution pattern along a plane containing both the reflector axis $A_R$ and the lamp axis $A_L$.

To compensate for the non-uniform light distribution pattern produced by the back reflector 50 resulting from mounting the lamp 20 with its axis $A_L$ offset from the reflector axis $A_R$, the invention provides a substantially symmetrical front reflector 60 which comprises at least one ellipsoidal reflecting surface 62. The front reflector 60 is preferably hingedly connected to the back reflector 50 at or about the lower limit of the back reflector 50, as at hinge 44, such that the front reflector 60 can be pivoted away from the back reflector 50 as shown in FIG. 2 to expose the arc lamp 20 and thus facilitate cleaning and maintenance. A detachable clip, bracket, thumbscrew or any other suitable fastening member (not shown) retains the front reflector 60 in the operating position shown in FIG. 1.

Figure 6A:
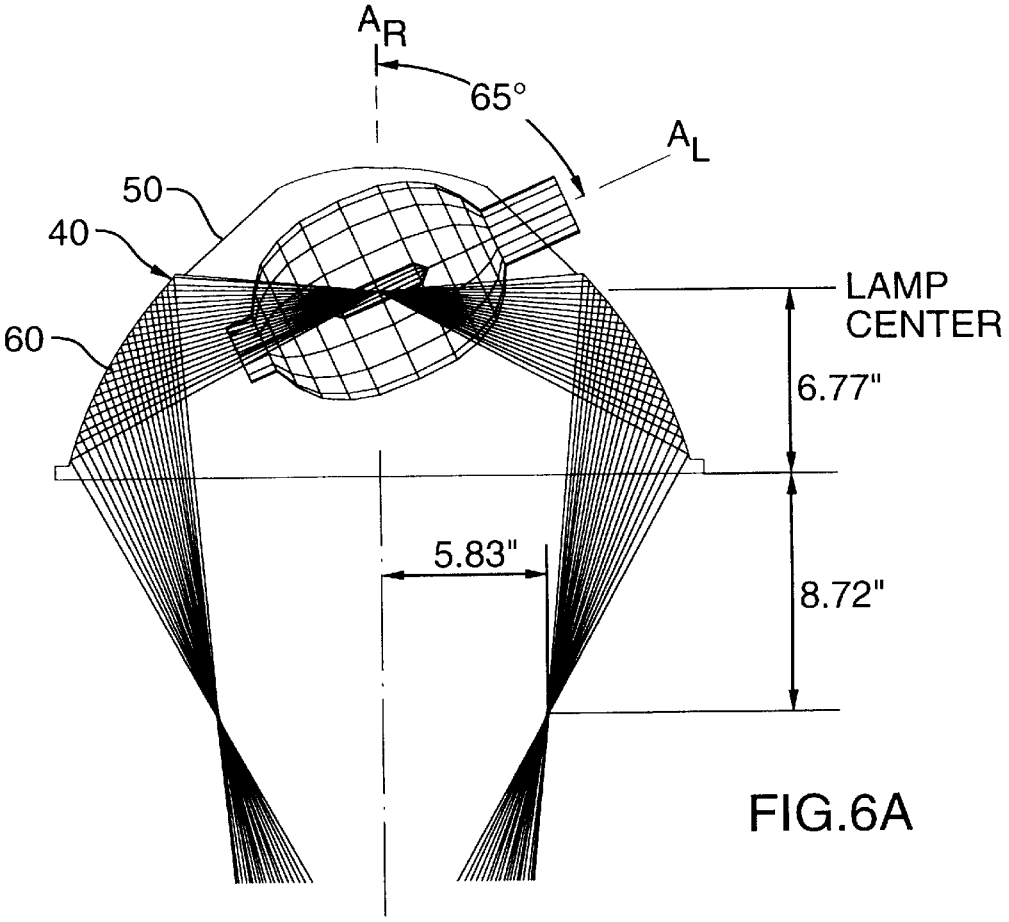
Figure 6B:
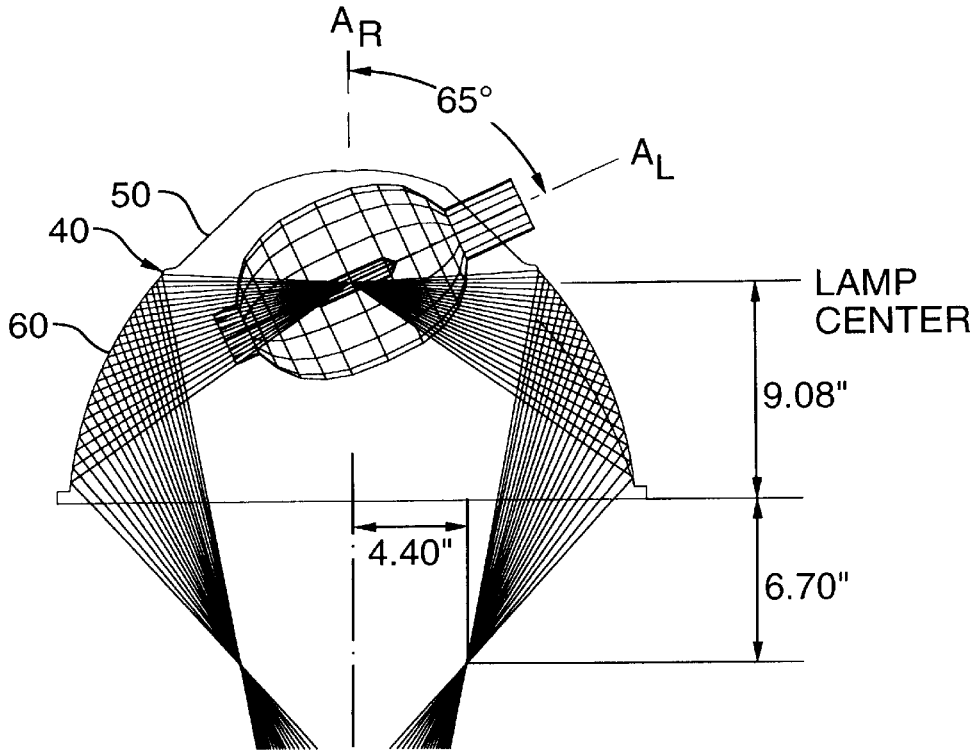
Figure 6C:
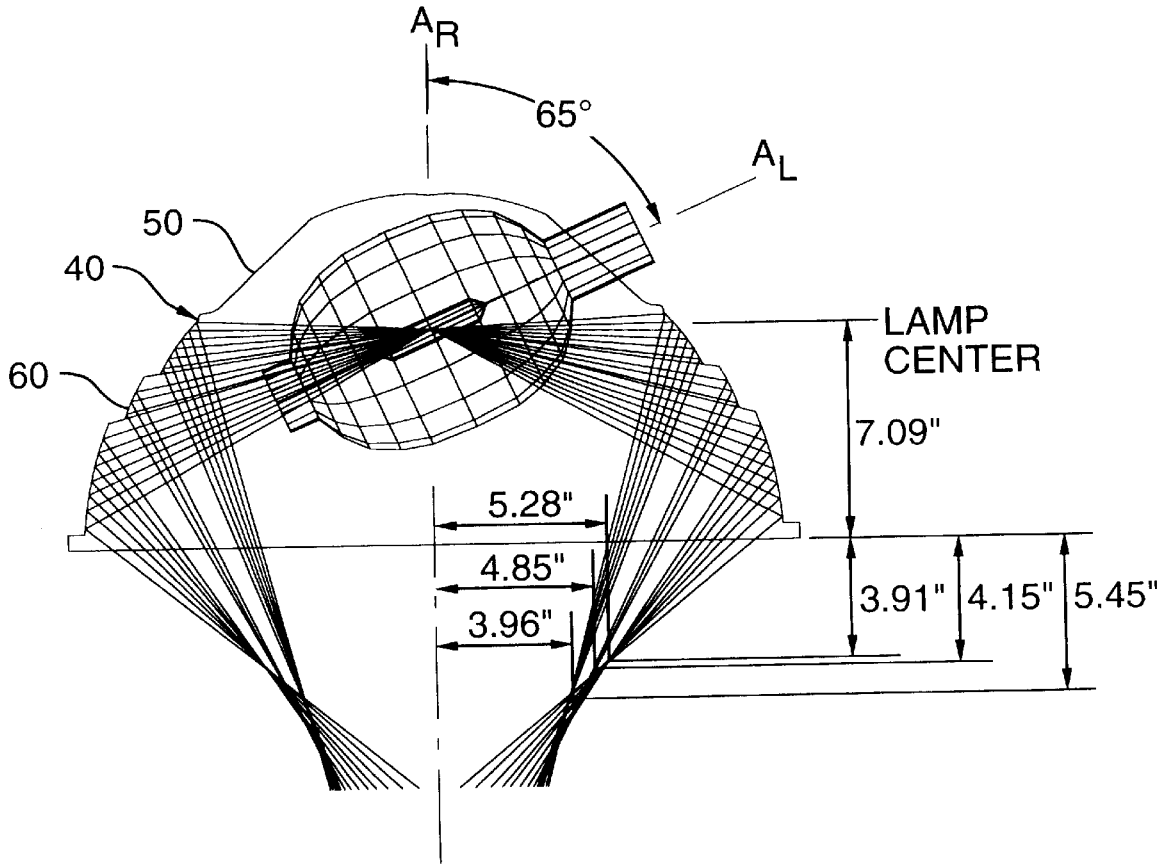

As shown in FIGS. 6*a*, 6*b* and 6*c*, the ellipsoidal reflecting surface 62 of the front reflector 60 is configured to reflect incident light from the lamp 20 and focus reflected light into an annular pattern coaxial with the reflector axis $A_R$. The ellipsoidal reflecting surface 62 is defined by an elliptical cross-section or profile having two focal points. The center of illumination is the first focal point of the elliptical profile. The locus of the second focal point of the elliptical profile is selected according to the desired light distribution pattern, wider dispersion being achieved by locating the second focal point closer to the reflector axis $A_R$.

Thus, FIG. 6*a* illustrates a floodlight having a relatively narrower distribution pattern than the floodlight of FIG. 6*b,* the second focal point of the outer reflector 60 in FIG. 6*a* being located further from the center of illumination than the second focal point of the outer reflector 60 in FIG. 6*b*.

As shown in FIG. 7, the shape of the ellipsoidal surface 62 is thus defined by an ellipse in which the sum of the light ray distances a (from the center of illumination to the ellipsoidal surface 62) and b (from the ellipsoidal surface 62 to the second focal point) is constant.

The locus of the second focal point of the elliptical profile is selected to be axially between the center of illumination and the target surface, and radially between the reflector axis $A_R$ and the inner periphery 64 of the front reflector 60. Preferably the second focal point is located axially beyond the outer periphery 66 of the front reflector 60, although for a very wide distribution pattern the second focal point could be located within the front reflector 60. However, locating the second focal point at the position of glass lens 42 should be avoided, since the concentration of heat could damage the lens 42.

FIG. 6*c* illustrates a floodlight having a series of stepped interior ellipsoid reflecting surfaces 62, the elliptical profile of each having a common first focal point at the center of illumination and different second focal points selected to produce a less intense annular focal region. This embodiment provides a particularly wide distribution pattern, however the respective second focal points should be relatively close together in order to cast a reasonably uniform illumination onto the target surface.

The principles of the invention have been described and illustrated in the context of reflective surfaces having a high reflectivity. It will be appreciated that some amount of reflector absorption and some degree of dispersion of the reflected light is inevitable, even desirable in some instances to create particular light distribution patterns. Also, the arc lamp 20 does not distribute light perfectly symmetrically and the three dimensional geometry of the reflector 40 is subject to normal manufacturing tolerances. Some variation in the light distribution pattern will occur in practise due to these factors, which can be compensated for by varying the position of the second focal point and the reflectivity of the parabolic reflective surface 52 or the ellipsoidal reflective surface 62, or both.

A preferred embodiment of the invention having been thus described by way of example only, it will be apparent to those skilled in the art that certain modifications and adaptations may be made without departing from the scope of the invention, as set out in the appended claims.

We claim:

1. A floodlight comprising a reflector having a reflector axis, the reflector comprising a back reflector having a substantially parabolic reflecting surface disposed substantially symmetrically about the reflector axis, a front reflector having at least one substantially ellipsoidal reflecting surface disposed substantially symmetrically about the reflector axis and mounted forwardly of the back reflector, the substantially ellipsoidal reflecting surface comprising an integral series of elliptical profiles, each elliptical profile having an axis, a first focus disposed substantially at a center of illumination and a second focus, and a lamp receptacle for mounting a lamp having a lamp axis and a center of illumination disposed along the lamp axis, wherein the axis of at least one elliptical profile is in substantial alignment with the axis of at least one other elliptical profile and the second focus of said at least one elliptical profile is not coincident with the second focus of said at least one other elliptical profile.

2. The floodlight of claim 1 in which the lamp is an arc lamp.

3. The floodlight of claim 1 in which the second focus of said at least one elliptical profile and the second focus of said at least one other elliptical profile are radially disposed between the reflector axis and an inner periphery of the front reflector.

4. The floodlight of claim 3 in which the second focus is axially disposed between the center of illumination and a target surface.

5. The floodlight of claim 4 in which the second focus of said at least one elliptical profile and the second focus of said at least one other elliptical profile are axially disposed between an outer periphery of the front reflector and the target surface.

6. The floodlight of claim 5 in which a focus of the parabolic reflecting surface is disposed substantially at the center of illumination.

7. The floodlight of claim 6 in which the back reflector includes a planar reflecting surface disposed about the parabolic reflecting surface.

8. The floodlight of claim 2 in which the arc lamp has a lamp axis disposed substantially vertically when the reflector axis is oriented at an oblique downward angle.

9. The floodlight of claim 1 in which the front reflector is hingedly connected to the back reflector and can be pivoted away from the back reflector to expose the lamp.

10. A floodlight comprising a lamp having a lamp axis, a center of illumination disposed along the lamp axis, and an asymmetric light distribution pattern about the center of illumination, a reflector having a reflector axis, the lamp being mounted in the reflector such that the lamp axis is offset from the reflector axis, the reflector comprising a back reflector having a substantially parabolic reflecting surface disposed substantially symmetrically about the reflector axis, and a front reflector having at least one substantially ellipsoidal reflecting surface disposed substantially symmetrically about the reflector axis and mounted forwardly of the back reflector, the substantially ellipsoidal reflecting surface comprising an integral series of elliptical profiles, each elliptical profile having an axis, a first focus disposed substantially at a center of illumination and a second focus, wherein the axis of at least one elliptical profile is in substantial alignment with the axis of at least one other elliptical profile and the second focus of said at least one elliptical profile is not coincident with the second focus of said at least one other elliptical profile.

11. The floodlight of claim 10 in which the lamp is an arc lamp.

12. The floodlight of claim 10 in which the second focus of said at least one elliptical profile and the second focus of said at least one other elliptical profile are radially disposed between the reflector axis and an inner periphery of the front reflector.

13. The floodlight of claim 12 in which the second focus of said at least one elliptical profile and the second focus of said at least one other elliptical profile are axially disposed between the center of illumination and a target surface.

14. The floodlight of claim 13 in which the second focus of said at least one elliptical profile and the second focus of said at least one other elliptical profile are axially disposed between an outer periphery of the front reflector and the target surface.

15. The floodlight of claim 14 in which a focus of the parabolic reflecting surface is disposed substantially at the center of illumination.

16. The floodlight of claim 15 in which the back reflector includes a planar reflecting surface disposed about the parabolic reflecting surface.

17. The floodlight of claim 11 in which the lamp axis is disposed substantially vertically when the reflector axis is oriented at an oblique downward angle.

18. The floodlight of claim 15 in which the front reflector is hingedly connected to the back reflector and can be pivoted away from the back reflector to expose the arc lamp.

19. A light fixture comprising a reflector having a reflector axis, the reflector comprising a back reflector and a front reflector mounted forwardly of the back reflector, the front reflector and back reflector being oriented to reflect light in substantially the same direction and the front reflector having an opening to transmit therethrough light reflected from the back reflector, the front reflector being hingedly connected to the back reflector so as to be pivotable away from the back reflector to expose a lamp.

20. The light fixture of claim 19 in which the back reflector comprises a substantially parabolic reflecting surface disposed substantially symmetrically about the reflector axis.

21. The light fixture of claim 20 in which the front reflector comprises at least one substantially ellipsoidal reflecting surface disposed substantially symmetrically about the reflector axis.

22. The light fixture of claim 19 in which the lamp is an arc lamp and is disposed substantially vertically when the reflector axis is oriented at an oblique downward angle.

23. The light fixture of claim 19 in which the front reflector comprises a glass lens.

24. A floodlight comprising a reflector having a reflector axis, the reflector comprising a back reflector having a substantially parabolic reflecting surface disposed substantially symmetrically about the reflector axis, a front reflector having at least one substantially ellipsoidal reflecting surface disposed substantially symmetrically about the reflector axis, mounted forwardly of the back reflector and in substantially the same direction as the back reflector and having an opening to transmit therethrough light reflected from the back reflector, and a lamp receptacle for mounting a lamp, wherein the front reflector is hingedly connected to the back reflector and can be pivoted away from the back reflector to expose the lamp.

25. The floodlight of claim 24 in which the lamp is an arc lamp.

26. The floodlight of claim 24 in which the lamp axis is disposed substantially vertically when the reflector axis is oriented at an oblique downward angle.

* * * * *